United States Patent [19]

Manusch et al.

[11] Patent Number: 4,583,875

[45] Date of Patent: Apr. 22, 1986

[54] METHOD OF NIB ATTACHMENT

[75] Inventors: Christoph Manusch, Hanover; Günter Scholz, Garbsen, both of Fed. Rep. of Germany

[73] Assignee: Pelikan Aktiengesellschaft, Hanover, Fed. Rep. of Germany

[21] Appl. No.: 574,652

[22] Filed: Jan. 27, 1984

[30] Foreign Application Priority Data

Jan. 29, 1983 [DE] Fed. Rep. of Germany ..... 3302963

[51] Int. Cl.[4] ..... B43K 15/00; B43K 8/02

[52] U.S. Cl. ..... 401/133; 401/134; 401/198; 401/199

[58] Field of Search ..... 401/198, 199, 133, 134, 401/135

[56] References Cited

U.S. PATENT DOCUMENTS

| | | | |
|---|---|---|---|
| 1,545,656 | 7/1925 | Hothersall | 401/198 |
| 3,234,918 | 2/1966 | Gigli | 401/134 |
| 3,345,674 | 10/1967 | De Groft | 401/198 |
| 3,687,561 | 8/1972 | Phillips | 401/134 |

FOREIGN PATENT DOCUMENTS

| | | | |
|---|---|---|---|
| 1977740 | 1/1968 | Fed. Rep. of Germany . | |
| 2319942 | 10/1974 | Fed. Rep. of Germany | 401/199 |
| 2425500 | 12/1975 | Fed. Rep. of Germany | 401/199 |
| 2647748 | 4/1978 | Fed. Rep. of Germany | 401/199 |
| 1531571 | 5/1968 | France | 401/132 |
| 1017342 | 1/1966 | United Kingdom | 401/134 |
| 1317312 | 10/1971 | United Kingdom . | |

*Primary Examiner*—Steven A. Bratlie

*Attorney, Agent, or Firm*—Karl F. Ross; Herbert Dubno

[57] ABSTRACT

A writing instrument having a capability tip is formed by piercing a membrane between the mouth of the housing and the reservoir with a tool to provide an opening of the size and shape of the shank of the nib which is then introduced into the opening.

2 Claims, 11 Drawing Figures

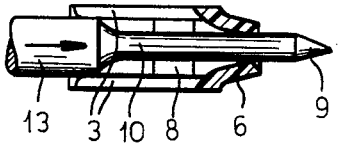
FIG. 3.1
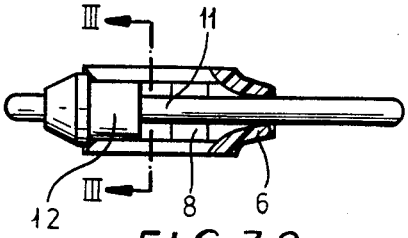
FIG. 3.2
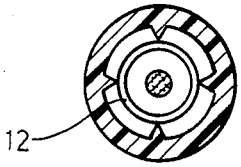
FIG. 3.3
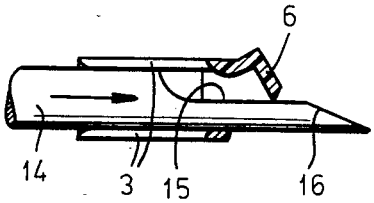
FIG 4.1
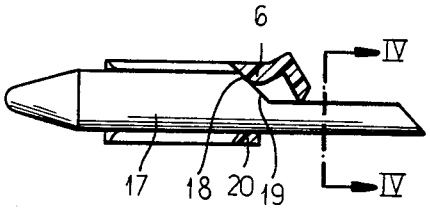
FIG. 4.2
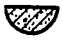
FIG. 4.3
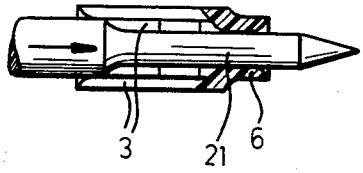
FIG. 5.1
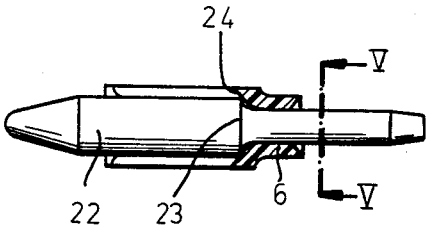
FIG. 5.2
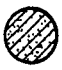
FIG 5.3

METHOD OF NIB ATTACHMENT

FIELD OF THE INVENTION

Our present invention relates to a writing instrument and, more particularly, to a writing instrument of the wick or felt-tip type and most specifically to a writing instrument in which the tip draws by capillary or wicking action a liquid writing medium, hereinafter referred to as ink, from a reservoir in the instrument. The invention also relates to a method of making such an instrument.

BACKGROUND OF THE INVENTION

In general, a so-called fiber or felt-tip pen or marker can be described as a writing instrument having a barrel which is provided at the writing end thereof with a writing tip from which a writing fluid, for convenience referred to as an ink, is transferred in a thin layer or film and in liquid form to the surface to which the transfer to the writing medium is to be made. Characteristic of such instruments is the fact that the tip draws the liquid ink from a reservoir in the barrel of the instrument by a wicking action, i.e. by capillarity so that the tip or "nib" can be termed a writing wick.

The writing wick or nib can be of various types and generally can be a sheathed wick or an unsheathed wick. A sheathed wick can be a comparatively thin nib encased in a metal sleeve while the unsheathed wick can have a relatively thick writing tip of the type commonly seen in so-called felt-tip markers.

The writing end of the tip can be round or of a different shape, the diameter can be rotationally symmetrically stepped or the felt wicking body can be stepped so that a thinner portion or a portion of reduced cross section reaches toward the ink reservoir.

Corresponding retaining systems must be provided depending upon the shape and nature of the nib or writing wick.

In the British Pat. No. 1,317,312, the writing tip is referred to as a nib core for a fiber-tipped writing instrument and the rotationally symmetrically stepped nib core at its narrower cross section is pressed into the tip of the barrel or housing so that the friction between the housing and the barrel holds the nib in place. The narrow portion extends into the reservoir to draw the ink or writing medium therefrom. The step of the nib facilitates seating of the nib against the tip of the housing and hence the axial positioning of the nib when the latter is passed into the housing.

One of the disadvantages of this system is that to avoid extension of the nib against the retaining friction force, the length of the bore in which the nib is frictionally retained must be comparatively great and where the housing is of a soft material, the pressure which is applied along this length of the bore wall must be considerable so that the excessive hugging action of the housing on the nib tends to restrict the flow of the writing medium to the tip of the nib.

In a German patent document (utility model) DE-GM No. 1.977,740 the fiber nib is disposed in the bore of a synthetic resin sleeve which, in turn, is set into the opening in the tip of the housing of the writing instrument. This sleeve defines within the bore longitudinally extending venting passages which interconnect the ink reservoir with the ambient atmosphere and thus permit free flow of the ink to the wick formed by the fiber nib.

The attachment of the fiber nib utilizes projections disposed between these passages in the sleeve and which are pressed inward upon insertion of the sleeve in the housing, to grip the fiber nib. This arrangement is of limited versatility because it can only be utilized for one type of fiber nib and is also expensive so that the resulting writing instrument may have a prohibitive cost. Furthermore, the nib, sleeve and passage assembly of this system may also be of excessive length for many purposes.

OBJECTS OF THE INVENTION

It is, therefore, the principal object of the present invention to provide a writing instrument with a fiber nib whereby these disadvantages do not arise.

Another object of the invention is to provide a fiber-tip or felt-tip writing instrument which is of low cost, utilizing a retaining assembly for the fiber nib which is of reduced length, and which has significantly increased versatility as to the nature of the nib which can be used with a particular housing structure.

Yet another object is to provide an improved method of making a writing instrument.

SUMMARY OF THE INVENTION

These objects and others which will become apparent hereinafter are attained, in accordance with the present invention, by a writing instrument having an elongated housing or barrel provided with a tip at which a fiber nib is to be disposed and a reservoir for a writing medium inwardly of this tip, the housing being provided inwardly of an opening of this tip and transverse to its longitudinal axis with a membrane which is transmitted integral and unitary with the housing and which, prior to insertion of the nib, is pierced in dimension and formed with an opening corresponding to the cross section of the fiber tip to be received therein and into which a shank of the fiber tip is then pressed so as to retain the fiber tip without play.

It will be apparent that with the system of the invention, wherein the membrane can be pierced to accommodate any size or shape fiber-nib shank, i.e. wherein in a simple shape an opening of the form and size of the shank of the fiber nib can be formed in the membrane, the versatility of the instrument is greatly increased since thick or thin nibs, concentric or eccentric nibs and indeed nibs of a wide variety of shapes and sizes can be accommodated in a single housing type with precision of retention of the nib and its orientation. Since the shank of the nib beyond to the membrane within the housing enters the reservoir with only a limited degree of constriction, the capillary flow from the reservoir is not significantly affected. This is especially the case where this membrane is located inwardly of the opening and, as described previously, is connected to the wall of the housing at the opening by ribs which at least in part define channels communicating with the reservoir along the inner wall of the opening.

The membrane is pierced according to the invention so that a portion thereof is deflected, i.e. the material of the opening is not removed so that the membrane will retain the shank of the fiber nib elastically. If the membrane converges rearwardly and the piercing of the membrane is effected in the direction of convergence, the pierced membrane is used as a unidirectional lock, completely preventing extraction of the shank of the fiber nib traversing the opening. The clamping effect can be further increased by the protuberance or evagination of the edge of the membrane surrounding the opening and formed upon the insertion of the shank of the fiber nib therethrough.

An especially advantageous embodiment of the invention provides that the membrane has the configuration of a cone which is coaxial with the longitudinal axis of the mouth of the housing with the apex of the cone turned toward the reservoir. This conical shape of the membrane simplifies the centering of a coaxial inner end of the fiber nib when it is inserted into the housing and also facilitates such insertion. This ensures especially in automated nib-setting systems elimination of alignment and other defects which might otherwise arise. The conical shape also provides a substantially symmetric evagination of the membrane during insertion of the nib shank and reduces the danger that the shank will be bent during such insertion. It has been found to be especially advantageous to dimension the membrane and the shank of the nib penetrating it so that in the evaginated position, when the shank is held in the membrane, the cross section of the membrane is hyperboloidal.

As noted earlier, we have found it to be highly advantageous to provide the mouth or tip of the housing with longitudinally extending guide ribs which can define channels communicating between the outer end of the housing and the inner chamber thereof. These ribs can be extended axially inwardly, i.e. in the direction of the reservoir and at their innermost extremities can be formed unitarily with the membrane.

This configuration facilitates the venting of the reservoir through the channels formed between the ribs and in the extended regions of the ribs these venting channels can communicate with an angular compartment surrounding the nib shank and connected, in turn, with the reservoir. An additional stabilization of the membrane can be ensured if the extended ends of these ribs are supported against the wall of the housing by supporting webs extending radially outwardly toward the housing wall.

The guide ribs of the present invention advantageously have the configuration of triangular prisms which can engage the shank of the fiber nib along respective edges. Since these edges have minimum friction against the shank of the nib, they guide the shank inwardly with a minimum of resistance and, to the extent that these edges penetrate into these nibs, serve to prevent rotation of the nib in the housing. This configuration of the guide ribs also permits wide tolerance ranges between the mouth of the housing and the nib which is to be accommodated therein.

It has been found to be advantageous also to provide the outer edge of the membrane so that it forms an axial abutment for a stepped portion or shoulder of the fiber nib. This is especially advantageous with thick fiber nibs which can practically fill the cross section of the mouth of the housing and where other means for preventing excessive movement of the nib into the housing are not provided. Such an arrangement permits a particularly slender configuration of both the mouth of the housing and the nib.

According to a method aspect of the invention, the membrane is pierced with a tool having a sharp piercing tip and a configuration corresponding to that of the shank of the fiber nib to be received in the opening thus pierced in the membrane. After removal of the profile-piercing tool, the fiber nib is introduced until it engages the axial abutment, e.g. a shoulder at the mouth or the abutment adjacent the membrane previously mentioned. This process allows the fiber nib to be introduced in a simple manner into a previously fabricated housing which may even have already been filled with ink or which may contain a full ink reservoir which has also been previously introduced into the housing. Proper alignment of the tool and the housing during penetration of the membrane can be effected by ensuring that the tool is guided and centered by the ribs previously mentioned. This eliminates the need for any complex external guide systems and ensures that fabricating tolerances can be maintained and are determined by the opening. Tolerance differences with respect to the axis of the opening vis-a-vis the axis of the outer wall of the housing do not pose a problem.

BRIEF DESCRIPTION OF THE DRAWING

The above and other objects, features and advantages of the present invention will become more readily apparent from the following description, reference being made to the accompanying drawing in which:

FIG. 3.1 is a diagram showing the piercing of the membrane with a thin concentric tool;

FIG. 3.2 is a diagrammatic section illustrating the same membrane accommodating the shank of a fiber tip of the metal-sheathed type;

FIG. 3.3 is a cross sectional view taken in the direction of the line III—III of FIG. 3.2;

FIG. 4.1 is a view similar to FIG. 3.1 but showing the piercing of a membrane using an eccentric tool;

FIG. 4.2 is a section illustrating the accommodation of a stepped or longitudinally divided fiber nib in the membrane pierced in FIG. 4.1;

FIG. 4.3 is a section taken along the line IV—IV of FIG. 4.2;

FIG. 5.1 is another section similar to FIG. 3.1 showing the piercing of a membrane by a comparatively thick tool;

FIG. 5.2 is a section of an unsheathed fiber nib received in the latter membrane; and FIG. 5.3 is a section taken along the line V—V of FIG. 5.2.

SPECIFIC DESCRIPTION

Figure 1:
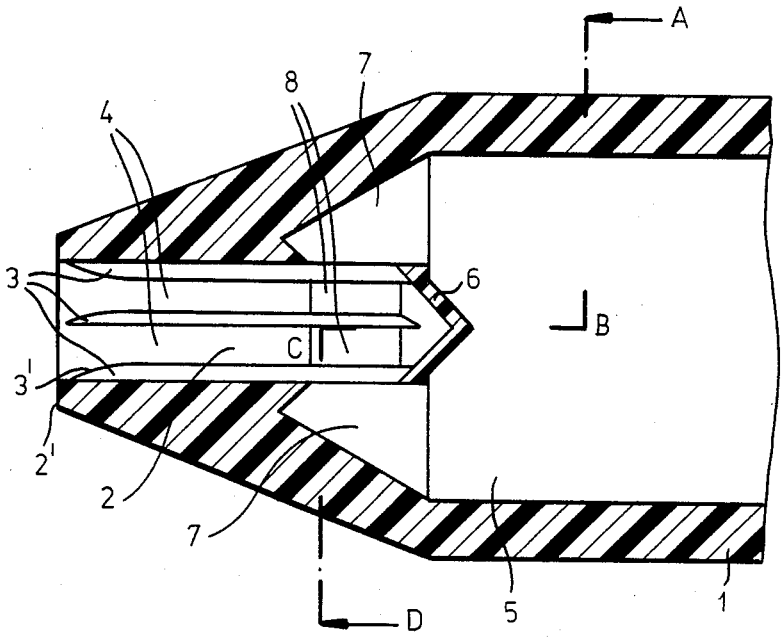
FIG. 1 is an axial cross sectional view through the mouth of the housing of a writing instrument according to the invention.
Figure 2:
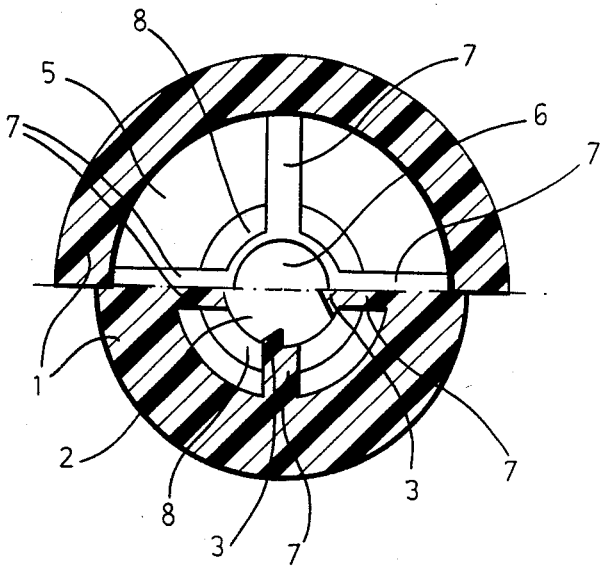
FIG. 2 is a section taken generally along the lines A–D of FIG. 1.

FIG. 1 shows the tip of an elongated housing 1 of a writing instrument prior to the mounting of a felt tip or fiber nib thereon. The housing 1 is an injection-molded synthetic-resin body and is provided with a mouth or bore 2 adapted to receive the writing nib and provided with longitudinally extending guide ribs 3 between which channels or passage 4 are formed. Each of the ribs 3 has the configuration of a triangular prism. At the outer ends, these ribs are rounded as can be seen at 3' in FIG. 1.

Toward the interior 5 of the housing, which encloses the reservoir for the ink or writing medium, the ribs 3 are extended beyond the mouth and carry at their inner ends, unitary therewith, a conical membrane 6 whose apex is turned toward the reservoir 5. Radial supporting webs 7 connect the membrane and the rib extensions with the housing wall. Between the webs 7 and the elongations of the ribs 3 spaces 8 are provided which communicate with the passages 4 and the reservoir 5.

To form the inner contour of the housing, only two cores are required in the injection process, one of which defines the reservoir 5, while the other defines the bore 2, spaces 8, and the channels 4, the two cores together defining the spaces into which the synthetic resin is injected to generate the membrane 6, the extensions of the ribs 3 and webs 7. The latter are formed by slots in the leading edge of one core while longitudinal slots define the ribs 3 in the other core.

The housing 1 can be used for various types of fiber nibs as will be apparent from the subsequent figures. To suit the housing 1 for the respective nib, the membrane 6 is pierced by a profile tool of corresponding shape. Through the pierced membrane thus formed, the shank of the fiber nib, guided by the ribs 3 until it abuts either the end 2' of the mouth or the shoulder 18 forming an abutment adjacent the membrane (see aslo FIG. 5.2).

In FIGS. 3.1, 3.2 and 3.3 the process for mounting a thin tip has been shown. Here the membrane 6 is pierced by a tool 10 having a concentric tip 9, the diameter of the tool 10 corresponding to the diameter of the fiber nib 11 which is then inserted. The fiber nib 11 has a thin shank which is received within the opening formed by the membrane 10.

Close to the outer end, the nib 11 has a metallic housing 12 which is held in place by the ribs 3, the housing 12 and the membrane 6 forming a double anchorage for the nib. The thick shaft 13 of the tool is guided on the ribs 3.

FIGS. 4.1, 4.2 and 4.3 illustrate the fact that the membrane 6 can be pierced by a tool 14 which is cylindrical and guided on the ribs 3 but has a cutting portion 16 which is eccentric and inclined to the axis. Between this cutting edge 16 and the body 14 of the tool, a flattened portion 15 is provided which has the configuration of the shank of the nib to be received in the pierced opening.

The membrane 6 is here cut loose at one side and bent upward as shown so that when the nib 17 is introduced, its eccentric shank passes through the opening and is engaged by the upwardly bent portion of the membrane as illustrated in FIG. 4.2.

In this embodiment, a shoulder of the nib 17, represented by the flank 19, can come to rest against the abutment 18 formed by the membrane.

This configuration prevents canting of the nib 17 during its insertion and the fixed margin 20 of the membrane and the deflected portion thereof retain the nib without play.

FIGS. 5.1, 5.2 and 5.3 illustrate an embodiment in which the stepped eccentric wisk 22 can be inserted after the membrane 6 has been pierced by the relatively thick portion 21 by a piercing tool. In this embodiment, the triangular-section ribs can penetrate into the unsheathed wick 22 and the abutment for the shoulder 23 is formed by the surface 24 of the membrane. The increased cross section of the opening in the membrane provides a secure retention of the nib in the axial and radial directions.

The housing can be fabricated from crystalline and even comparatively soft or yieldable amorphous synthetic resins and the capillary nibs can be felt or fiber nibs using resin-bonded fibers. However, the nibs can also be composed of sintered powders or can even be extruded nibs with longitudinal capillary channels. Because of the high degree of retentiveness, additional retaining devices or systems such as pins and adhesives are unnecessary.

We claim:

1. A method of making a writing instrument which comprises the steps of:

forming an elongated housing having an axis, a tip at an end of said housing formed with an axial bore opening at a mouth, a reservoir for a writing medium inward of said tip, and a transversely extending imperforate membrane disposed between said bore and said reservoir extending transversely to an axis of said housing and having the shape of a cone coaxial with said axis and having an apex turned toward said reservoir;

piercing said membrane without removing material therefrom with a tool having a configuration adapted to form an opening of a predetermined size and shape while elastically deflecting a portion of said membrane radially of said axis with said apex of said cone pointing radially away from said axis upon the formation of said opening;

withdrawing said tool from said opening; and inserting through said bore and into said opening the shank of a capillary writing nib integral with a writing tip thereof, said shank having said configuration and size with said portion bearing elastically and radially against said shank with said apex of said cone pointing radially away from said axis to retain said nib without play in said housing.

2. The method defined in claim 1 wherein said bore is provided with a plurality of axially extending guide ribs, this method further comprising the step of guiding the tool on said ribs for the piercing of said membrane.

* * * * *